US006410216B1

(12) United States Patent
Clarke et al.

(10) Patent No.: US 6,410,216 B1
(45) Date of Patent: Jun. 25, 2002

(54) METHOD OF FORMING A PHOTOGRAPHIC COLOR IMAGE

(75) Inventors: David Clarke, Watford; Paul Louis Reginald Stanley, Wealdstone, both of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/275,204

(22) Filed: Jul. 14, 1994

(51) Int. Cl.[7] ..... G03C 1/46

(52) U.S. Cl. ..... 430/505; 430/558; 430/546; 430/551; 430/566; 430/470; 430/476

(58) Field of Search ..... 430/505, 558, 430/546, 470, 476, 551, 566

(56) References Cited

U.S. PATENT DOCUMENTS 2,424,256 A 6/1947 Schmidt et al. ..... 95/88
4,481,268 A 11/1984 Bailey et al. ..... 430/1
5,260,177 A * 11/1993 Aoki et al. ..... 430/558
5,284,739 A * 2/1994 Clarke et al. ..... 430/546

FOREIGN PATENT DOCUMENTS

EP 0 331 185 9/1989

OTHER PUBLICATIONS

James, *The Theory of the Photographic Process,* Third Edition, 1966, p. 387, "Effect of Developer".*

* cited by examiner

*Primary Examiner*—Geraldine Letscher
(74) *Attorney, Agent, or Firm*—Arthur E. Kluegel

(57) ABSTRACT

Method of forming a photographic color image which comprises imagewise exposing a photographic silver halide color material and processing it with an alkaline processing solution in the presence of a sulphonhydrazide color developing agent and a 3-pyridinol color coupler optionally containing in the 2-position a ballasting group of such size and configuration as to render the coupler non-diffusible in photographic materials thus forming a dye image by reaction of the oxidized color developing agent and the color coupler.

9 Claims, No Drawings

METHOD OF FORMING A PHOTOGRAPHIC COLOR IMAGE

FIELD OF THE INVENTION

The present invention relates to methods for the formation of photographic color images in photographic silver halide color materials.

BACKGROUND OF THE INVENTION

Existing commercial photographic silver halide color materials form dye images by the reaction of oxidised p-phenylenediamine color developers with a color coupler. The color developing solutions employed contain the color developing agent and used developer solutions need to be disposed of safely. Attempts have been made to incorporate p-phenylenediamine color developing agents into silver halide photographic materials but these have had little success largely due to the pronounced staining produced.

The use of sulphonhydrazides as color developers in aqueous color developer solutions which form an azo dye on coupling with a color coupler are described in U.S. Pat. No. 2,424,256, U.S. Pat. No. 4,481,268 and copending British Application No. 9125688.3.

A problem encountered with this system is that it is difficult to obtain the desired hue for the magenta image, for example 1-naphtholic couplers give a violet hue.

European Patent Specification 0 331 185 A describes a class of 3-pyridinol color couplers which form cyan dyes with conventional phenylenediamine color developing agents. There is no suggestion that they will couple with sulphonhydrazide color developers of any sort.

SUMMARY OF THE INVENTION

The present invention provides a process in which a class of couplers are used with sulphonhydrazide color developers to form image dyes of desirable magenta hue.

According to the present invention there is provided a method of forming a photographic color image which comprises imagewise exposing a photographic silver halide color material and processing it with an alkaline processing solution in the presence of a sulphonhydrazide color developing agent and a 3-pyridinol color coupler optionally containing in the 2-position a ballasting group of such size and configuration as to render the coupler non-diffusible in photographic materials thus forming a magenta dye image by reaction of the oxidised color developing agent and the color coupler.

"The present invention also provides a color photographic material comprising at least two color-forming units sensitive to different regions of the spectrum each comprising a silver halide emulsion layer wherein the material contains in at least one said silver halide emulsion layer, a ballasted sulphonhydrazide color developing agent and a 3-pyridinol photographic color coupler capable of forming a magenta dye upon coupling with the oxidized form of said developing agent, both incorporated therein in droplets of a high boiling solvent."

DETAILED DESCRIPTION OF THE INVENTION

Advantages of the present invention include being able to photographically generate image dyes of desirable magenta hue without the use of p-phenylenediamine developers and allowing both the coupler and the color developer to be incorporated in the photographic material.

The present invention further provides a color photographic material comprising at least two color-forming units sensitive to different regions of the spectrum each comprising a silver halide emulsion layer characterised in that the material contains in or adjacent said layer, a ballasted photographic color coupler and a ballasted sulphonhydrazide color developing agent incorporated therein in droplets of a high boiling solvent and wherein the color coupler is a 3-pyridinol containing in the 2-position a ballasting group of such size and configuration as to render the coupler non-diffusible in photographic materials.

In a preferred embodiment the invention provides a color photographic material in which the material is a multicolor photographic material comprising a support bearing a yellow dye image-forming unit comprised of at least one blue-sensitive silver halide emulsion layer having associated therewith at least one yellow azo dye-forming coupler, at least one magenta dye image-forming unit comprising at least one green-sensitive silver halide emulsion layer having associated therewith at least one magenta dye-forming coupler at least one cyan dye image-forming unit comprising at least one red-sensitive silver halide emulsion layer having associated therewith at least one cyan dye-forming coupler.

The pyridinol color coupler preferably has the formula:

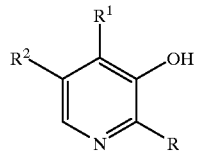

wherein

R is an electron-donating group, $R^1$ and $R^2$ are each hydrogen or a substituent or together complete a carbocyclic or heterocyclic ring which may be substituted, and wherein at least one of R, $R^1$ and $R^2$ contain a ballasting group of such size and configuration as to render the compound non-diffusible in photographic materials.

Examples of groups R are alkyl, alkoxy, alkylthio, hydroxy, —NHCONHR$^3$, —NHCOOR$^3$, amino, alkyamino or acylamino any of which may contain further substituents, of which specific examples are: methyl, trifluoromethyl, ethyl, t-butyl, octadecyl, benzyl, phenyl, ball-$SO_2$NH—, ball-CONH—, ball-NH$SO_2$—, ball-NHCO—, R$^3$CONH—, R$^3$NH—, R$^3SO_2$NH—, R$^3$NH— and —COO-alkyl wherein ball is a ballast group and R$^3$ is an alkyl or aryl group which may be substituted.

Examples of groups that $R^1$ and $R^2$ may represent are halogen (eg Cl, Br, F, I), alkyl, aryl, alkylaryl, arylalkyl, heterocyclic, amido, sulphonamido, carbamoyl, sulphamoyl any of which may be substituted.

Examples of rings that $R^1$ and $R^2$ may complete are benzene, naphthalene, pyridine or thiophene.

All the substituents referred to above should, as the skilled man will readily recognise, compatible with the function of the compound.

The azo dye is formed as illustrated below:

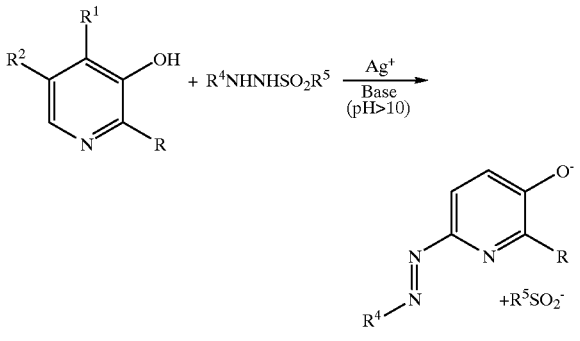

wherein $R^4$—$NHNHSO_2R^5$ represents the sulphonhydrazide developing agent.

The sulphonhydrazide color developing agent may have the formula:

$$R^4—NHNH—SO_2—R^5 \quad (2)$$

wherein $R^4$ is an aryl or heterocyclic group which may be substituted, and $R^5$ is an alkyl or aryl group, either of which may be substituted, and wherein $R^4$ or $R^5$ contains a ballasting group of such size and configuration as to render the compound non-diffusible.

A preferred group of developing agents of formula (2) are those in which $R^4$ is a heterocyclic group. Examples of $R^4$ are benzoxazole, benzthiazole, benzimidazole and naphthoxazole, naphthothiazole, naphthimidazole, quinoline and quinoxaline radicals, and preferably a 4-quinazolinyl group.

Examples of $R^5$ include alkyl, aryl, alkylaryl, arylalkyl or heterocyclic any of which may be substituted.

The coupler and the color developer may be incorporated in the photographic silver halide material or the developer. If incorporated in the material, the compound should have a ballasting group of such size and configuration to render it non-diffusible in the photographic material or be in the form of a polymeric coupler.

The ballast group may be attached to couplers of formula (1) by forming part of R, $R^1$ or $R^2$. The ballast group in the sulponhydrazides of formula (2) may be attached by forming part of either $R^4$ or $R^5$.

As is conventional with color couplers, the coupler and the developing agent may be incorporated in the photographic material in droplets of high boiling coupler solvent. The high boiling solvent used to incorporate the coupler and/or color developer in the photographic material may be any solvent known as a coupler solvent (and used for incorporating couplers into photographic materials). Many such solvents are listed in Research Disclosure Item 308119, December 1989 published by Kenneth Mason Publications, Emsworth, Hants, United Kingdom. The coupler and color developer may be incorporated in the same or different droplets of coupler solvent.

The pyridinol couplers used in the present invention may be prepared as described in "Pyridine and its Derivatives", Supplement Parts 1 and 3 (1974), ed. R A Abramovitch, Wiley Interscience, New York.

Examples of 3-pyridinol couplers of formula (I) are listed in the following table:

TABLE 1

(1)

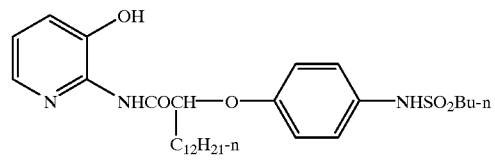

(2)

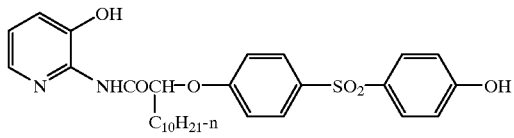

(3)

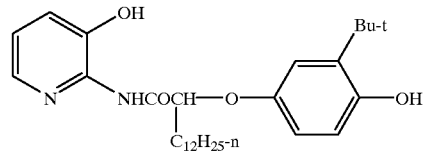

(4)

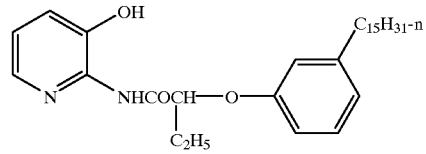

(5)

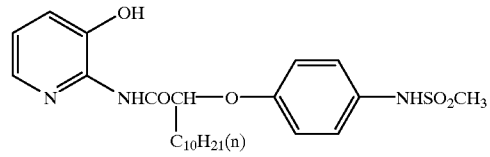

(6)

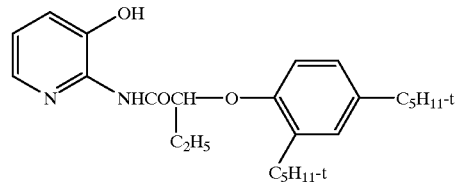

(7)

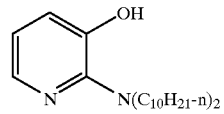

(8)

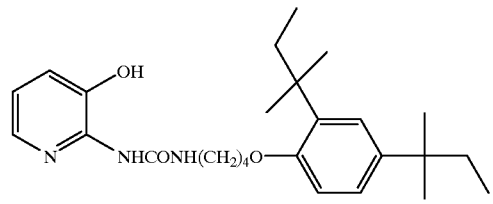

(9)

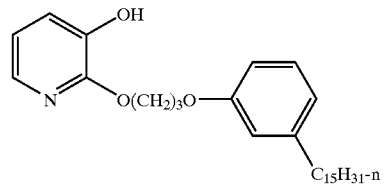

TABLE 1-continued
(10)
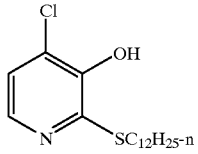
(11)
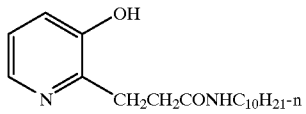
(12)
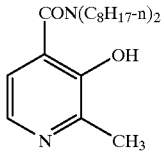
(13)
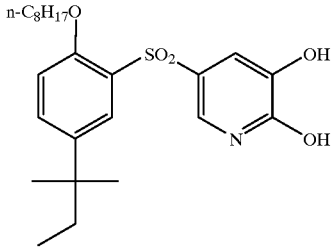
(14)
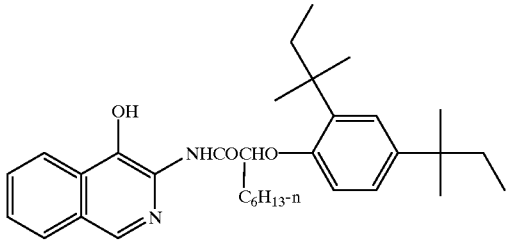
The fastness of the image dyes may be increased by coating a tertiary or quaternary amine at 25–50% molar laydown of coupler. An exemplary compound has the formula:
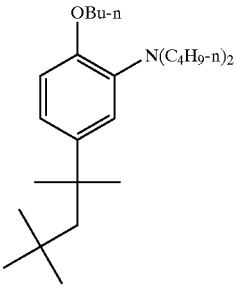
Many examples of suitable sulphonhydrazide color developers are listed in U.S. Pat. No. 5,284,739. Specific examples include the following:
(D1)
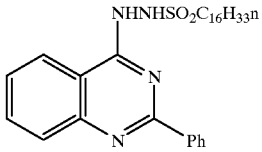
(D2)
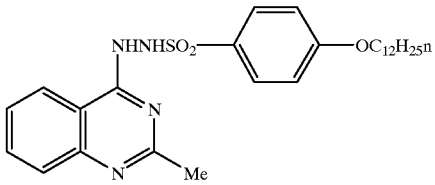
(D3)
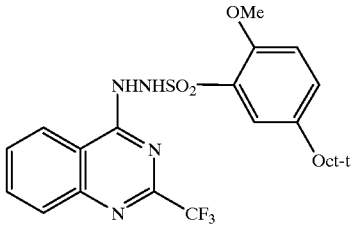
(D4)
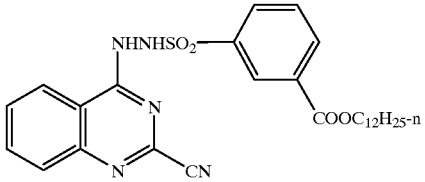
(D5)
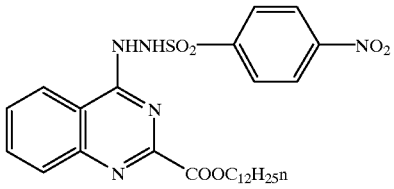
(D6)
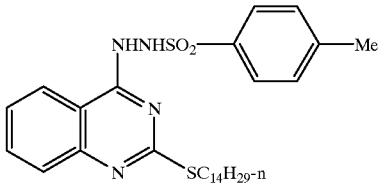
(D7)
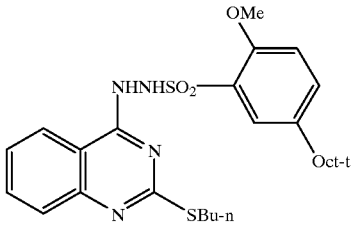

-continued (D8)

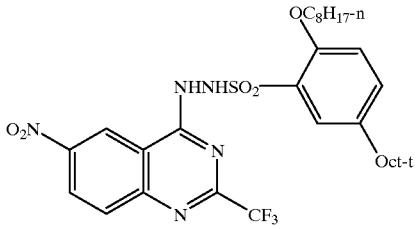

(D9)

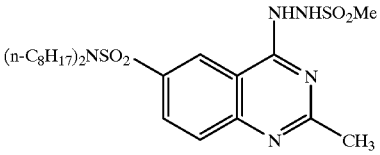

(D10)

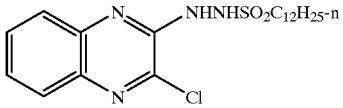

(D11)

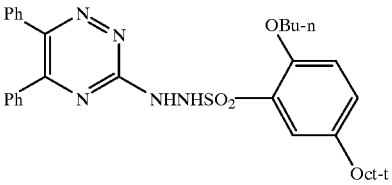

The present photographic materials, after imagewise exposure, may be processed by treatment in an alkaline solution. In such a process oxidised color developer forms in areas of silver halide development and the oxidised form of the developer couples with the coupler to form image dye.

In a preferred embodiment, the alkaline solution contains an electron transfer agent (ETA), for example a pyrazolidinone. A specific ETA that may be used is 4-hydroxymethyl-4-methyl-1-phenylpyrazolidin-3-one.

The following Examples are included for a better understanding of the invention.

EXAMPLE 1

Synthesis of Coupler 1

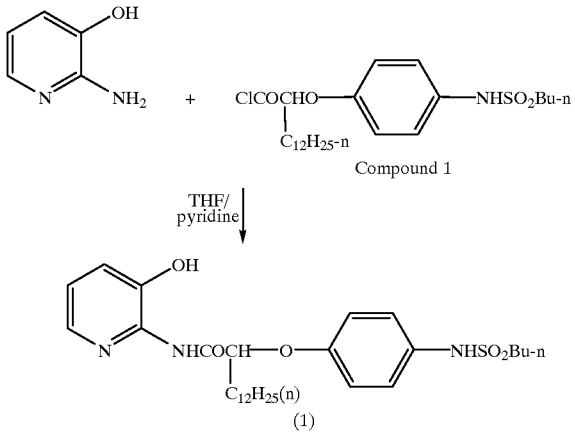

2-Amino-3-pyridinol (2.2 g, 0.02 mole) was dissolved in THF (200 m) together with a small quantity of DMF (15 ml) to aid solubility. Pyridine (5 ml) was added followed by the dropwise addition of freshly prepared ballast acid chloride (Compound 1) (10.0 g, 0.02 mole) dissolved in THF (30 ml). After stirring for 1 hour at room temperature, THF was removed under reduced pressure and the residual oil extracted into ethyl acetate (250 ml). The solution was washed successively with dilute hydrochloric acid and a solution of sodium hydrogen carbonate. After drying the ethyl acetate solution over magnesium sulphate, solvent was removed in vacuo to give the crude product.

Silica gel column chromatography eluting with a 3:2 60/80 petrol-ethyl acetate mixture, gave Coupler 1 as a colorless oil which crystallised on standing to an off-white solid. Trituration with 60/80 petrol gave the coupler as a white solid, 6.5 g (60%).

Found: C, 63.5; H, 8.0; N, 7.7; S, 5.7%; $C_{29}H_{45}N_3O_5S$ Req: C, 63.6; H, 8.3; N, 7.7; S, 5.9%; HPLC gave 100% purity; Mass gave the desired $MH^+$ at 548 m/z. Both IR and NMR were also consistent.

The other couplers listed in Example 2 may all prepared in a similar manner.

EXAMPLE 2

In this Example, the testing was done as described below.

Dispersions

The coupler dispersions used contained (w/w) 6.0% gelatin, 8.8% coupler, 1 molar equivalent of developer, and coupler solvents in the ratio coupler: tricresylphosphate: 2-(2-butoxyethoxy)ethyl acetate 1.0:0.5:1.5.

The dispersions were washed for 6 hours at 4° C.

Coatings

The coupler/developer dispersions were coated with a (green-sensitised) silver bromoiodide emulsion in the following format:

| | |
|---|---|
| Gel supercoat Gelatin | 1.5 $gm^{-2}$ |
| Emulsion Layer Silver bromoiodide | 1.61 $gm^{-2}$ |
| Coupler (+dev) | 1.04 mmol $m^{-2}$ |
| Gelatin | 2.42 $gm^{-2}$ |
| Bis (vinylsulphonyl)-methane (hardener) | 0.06 $gm^{-2}$ |
| Support Cellulose Acetate | |

The coatings were slit and chopped into 30 cm×35 mm strips and exposed (0.1 sec, DL V+WR 9 filters) and processed through the following sequence, using an activator solution of the given composition:

Processing Sequence at 37.8° C.

Activator 2.5 min

Wash 1.0 min

Bleach 4.0 min

Wash 2.0 min

Fix 4.0 min

Wash 2.0 min

Base Dip 1.0 min

| Activator Solution | |
|---|---|
| $Na_2CO_3$ | 26.5 g/l |
| $NaHCO_3$ | 6.3 |
| $Na_2SO_3$ | 2.0 |
| NaBr 1.0 | |

-continued

| Activator Solution | |
|---|---|
| 4-hydroxymethyl-4-methyl-1-phenylpyrazolidin-3-one | 0.2 |
| Water to | 1.0 1 |
| pH = | 10.4 |

The post-process base dip (pH 10.4 solution—$Na_2CO_3$ 26.5 g/l and $NaHCO_3$ 6.3g/l) is required to obtain the full-colored anionic form for the magenta azo dye.

A coating was made as described above using the Couplers identified below (with reference to Table 1) with developer D3 described above.

In the table of results below, $D_{max}$ is the Status M green density, $^{\lambda}$max, and $^{\lambda}$½ are in nm. $^{\lambda}$½ is measured at the mid point of a horizontal line drawn inside the absorption curve at the half bandwidth (Hbw) level and indicates the symmetry of the curve; the size of the difference between $^{\lambda}$max and $^{\lambda}$½, indicates increasing asymmetry.

The control coupler had the formula:

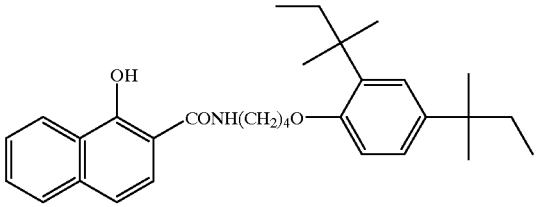

| Coupler | $D_{max}$ | $\lambda_{max}$ | $\lambda_{½}$ | Hbw | Hue |
|---|---|---|---|---|---|
| 1 | 1.05 | 546 | 527.5 | 146 | Magenta |
| 2 | 0.68 | 530 | 532 | 141 | Magenta |
| 3 | 0.60* | 530 | 528 | 136 | Magenta |
| 4 | 1.30 | 542 | 525.5 | 148 | Magenta |
| 5 | 0.33* | 552 | — | — | Magenta |
| 6 | 0.58 | 558 | 521 | 149 | Magenta |
| Control | 1.35 | 566 | 546 | 145 | Violet |

*crystalline

It can be seen from the table that couplers of the present invention provide useful magenta azo dye images when oxidatively coupled with quinazoline sulphonhydrazide developers. The wavelength of maximum absorption ($^{\lambda}$max) and ($^{\lambda}$½) show that the dyes formed have much more desirable spectral properties than the control.

In addition with a tertiary amine of the formula:

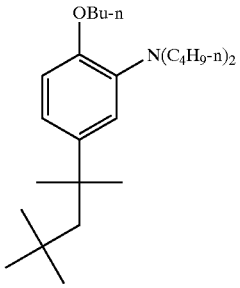

at 35% molar laydown of the coupler a more stable dye image was obtained, although the 1 min post-process base dip was still required.

What is claimed is:

1. A color photographic material comprising at least two color-forming units sensitive to different regions of the spectrum each comprising a silver halide emulsion layer wherein the material contains in at least one said silver halide emulsion layer, a ballasted sulphonhydrazide color developing agent and a 3-pyridinol photographic color coupler capable of forming a magenta dye upon coupling with the oxidized form of said developing agent, both incorporated therein in droplets of a high boiling solvent.

2. A material as claimed in claim 1 in which the pyridinol color coupler has the general formula:

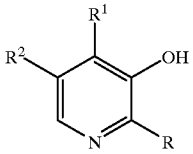

wherein

R is an electron-donating group, $R^1$ and $R^2$ are each hydrogen or a substituent or together complete a carbocyclic or heterocyclic ring, and wherein at least one of R, $R^1$ and $R^2$ contains a ballasting group of such size and configuration as to render the coupler non-diffusible in photographic materials.

3. A material as claimed in claim 2 in which R is hydroxy or is selected from the group consisting of an alkyl, alkoxy, alkythio, —$NHCONHR^3$, —$NHCOOR^3$, amino, alkylamino or acylamino any of which may contain further substituents, wherein $R^3$ is an alkyl or aryl group which a substituted or unsubstituted.

4. A material as claimed in claim 3 in which said substituents are methyl, trifluoromethyl, ethyl, t-butyl, octadecyl, benzyl, phenyl, ball-$SO_2NH$—, ball-CONH—, ball-$NHSO_2$—, ball-NHCO—, $R^3CONH$—, $R^3NH$—, $R^3SO_2NH$—, $R^3NH$— and —COO-alkyl wherein ball is a ballast group and $R^3$ is an alkyl or aryl group which is substituted or unsubstituted.

5. A material as claimed in claim 2 in which $R^1$ and $R^2$ are each independently (1) halogen, or (2) selected from the group consisting of alkyl, aryl, alkylaryl, arylalkyl, heterocyclic, amido, sulphonamido, carbamoyl, sulphamoyl any of which are substituted or unsubstituted, or (3) together complete a benzene, naphthalene, pyridine or thiophene ring.

6. A material as claimed in claim 1 in which the sulphonhydrazide developing agent has the general formula:

$$R^4—NHNH—SO_2—R^5 \quad (2)$$

wherein $R^4$ is an aryl or heterocyclic group which is substituted or unsubstituted, and $R^5$ is an alkyl or aryl group, either of which is substituted or unsubstituted, and wherein $R^4$ or $R^5$ contains a ballasting group of such size and configuration as to render the compound non-diffusible.

7. A material as claimed in claim 2 in which the sulphonhydrazide developing agent has the general formula:

$$R^4—NHNH—SO_2—R^5 \quad (2)$$

wherein $R^4$ is an aryl or heterocyclic group which is substituted or unsubstituted, and $R^5$ is an alkyl or aryl group, either of which is substituted or unsubstituted, and wherein $R^4$ or $R^5$ contains a ballasting group of such size and configuration as to render the compound non-diffusible.

8. A material as claimed in claim 1 in which both the coupler and the developing agent are co-dispersed in the same high boiling solvent droplets.

9. A material as claimed in claim 1 additionally containing in said silver halide emulsion layer an amine of the formula:

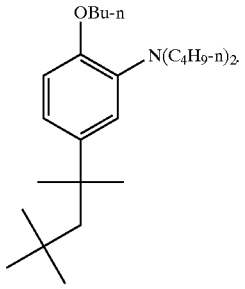

* * * * *